US006234697B1

(12) United States Patent
Kanari et al.

(10) Patent No.: US 6,234,697 B1
(45) Date of Patent: May 22, 2001

(54) MECHANICAL PENCIL

(75) Inventors: Hiroyuki Kanari, Aizuhongo-machi; Takeshi Kurihara, Aizuwakamatsu, both of (JP)

(73) Assignee: Micro Co., Ltd. (JP)

( * ) Notice: Subject to any disclaimer, the term of this patent is extended or adjusted under 35 U.S.C. 154(b) by 0 days.

(21) Appl. No.: 09/632,327

(22) Filed: Aug. 4, 2000

(30) Foreign Application Priority Data

Aug. 4, 1999 (JP) ..... 11-221404
Oct. 20, 1999 (JP) ..... 11-297728

(51) Int. Cl.[7] ..... B43K 21/22
(52) U.S. Cl. ..... 401/92; 401/93
(58) Field of Search ..... 401/92, 88, 93, 401/94

(56) References Cited

U.S. PATENT DOCUMENTS 3,892,495 * 7/1975 Naruse et al. ..... 401/93
4,056,325 * 11/1977 Maruyama ..... 401/93
4,230,413 * 10/1980 Gartner ..... 401/93
4,358,210 * 11/1982 Hashimoto et al. ..... 401/93

* cited by examiner

*Primary Examiner*—David J. Walczak
(74) *Attorney, Agent, or Firm*—Adams & Wilks

(57) ABSTRACT

A mechanical pencil comprises a main body, a lead-feeding mechanism disposed in the main body for gripping a lead at a lead-gripping position and for feeding the lead to an advanced position, and a mouthpiece connected to the main body. A slider is slidably fitted in the mouthpiece. A lead-holding member is disposed in the slider for frictionally holding the lead fed to the advanced position. A slider-resisting member is disposed in contact with the slider for applying a frictional resistance to the slider larger than a frictional resistance of the lead-holding member. Control portions are provided for controlling the frictional resistance applied to the slider by the slider-resisting member to bring the slider-resisting member in slight contact with or non-contact with the slider so that the frictional resistance of the slider-resisting member is smaller than the frictional resistance of the lead-holding member in a region corresponding to a return amount of the lead when the lead fed to the advanced position by the lead-feeding mechanism returns to the lead-gripping position.

10 Claims, 5 Drawing Sheets

MECHANICAL PENCIL

BACKGROUND OF THE INVENTION

1. Field of the Invention

The present invention relates to a mechanical pencil, and in particular, to a knocking-type mechanical pencil in which a remaining or unconsumed lead portion is pressed out by a following or next lead portion, and in which the remaining lead portion can be used until its length is shortened.

2. Background Art

FIG. 9A shows a conventional knocking-type mechanical pencil in which a remaining lead portion can be used until its length is shortened. The conventional knocking-type mechanical pencil has a cylindrical main body 1 and a lead-feeding mechanism disposed in the main body 1. The lead-feeding mechanism comprises a lead tank 3 containing a lead 2, a collet chuck 4 connected to the lead tank 3, a clutch 5 for clutching the collet chuck 4, and a spring 6 for biasing the lead tank 3 rearwardly. A mouthpiece 7 is connected to the main body 1, and a slider 13 extends into the mouthpiece 7. A lead-holding member 9 is disposed in the slider 13 and extends near to a front end of the slider 13 so as to hold the remaining lead portion. When a rear end portion of the lead tank 3 is knocked, since the collet chuck 4 is clutched by the clutch 5 at a lead-gripping position, the collet chuck 4 advances while gripping the lead 2. Then, when a flange of the clutch 5 abuts on a stepped portion 8 disposed in the mouthpiece 7, the collet chuck 4 comes out of the clutch 5 and its front end widens, whereby the lead 2 is released from gripping. At this time, the lead 2 is inserted into the lead-holding member 9 disposed in the mouthpiece 7 and is held at the advanced position by friction of the lead-holding member 9. When the knocking is stopped, the collet chuck 4 is moved backwardly by the action of the spring 6, and during this backward movement, the clutch 5 clutches the collet chuck 4 and the lead 2 is thereby gripped gradually. When the flange of the clutch 5 abuts on a shoulder portion 10, the collet chuck 4 returns to the gripping position and the lead 2 can be firmly gripped. As mentioned above, since the chuck 4 grips the lead 2 on its return to the gripping position from the advanced position and the lead 2 is transferred, the lead 2 moves backwardly a little from the advanced position.

The lead-holding member 9 has a lead insertion hole 11 and is made of an elastic material, such as rubber, so that it frictionally holds the lead 2. The lead-holding member 9 extends to near a front end in a slider 13 which is slidably fitted in a bore 12 of the mouthpiece 7. Inside the mouthpiece, a slider-resisting member 14 is disposed in contact with the periphery of the slider 13 so that a frictional resistance larger than a frictional resistance of the lead-holding member 9 is applied to the slider 13. By this structure, when the collet chuck 4 is moved to the advanced position by the knocking operation, the slider 13 is pushed forward and advances together with the chuck 4. When the front end of the slider 13 abuts on the paper surface and is pressed backwardly, the slider 13 moves backwardly, but when the mechanical pencil is not used, the slider 13 will not unnecessarily protrude or retract.

During a writing operation, the lead 2 of the mechanical pencil is fed out to such an extent that the front end of the lead 2 protrudes slightly outwardly from the front end of the slider 13. However, when the lead 2 is shortened or consumed and is no longer gripped by the collet chuck 4, a space 15 is formed between a remaining lead portion 2*a* and a following lead portion 2*b* as shown in FIG. 9A. Namely, as mentioned above, when the lead 2 returns from the advanced position to the gripping position by the lead-feeding mechanism, at the moment when the collet chuck 4 is engaged with the clutch 5, the collet chuck 4 returns clamping the following lead portion 2*b*, but the remaining lead portion 2*a* remains at the advanced position, whereby the space 15 will be formed between the remaining and following lead portions 2*a*, 2*b*. Accordingly, if the writing operation is continued, the remaining lead portion 2*a* slips within the lead-holding member 9 and moves backwardly until it abuts on the following lead portion 2*b* since the movement of the lead-holding member 9 is frictionally restrained by the slider-resisting member 14. As a result, the protruded front end of the lead 2 retracts in the distance of the space 15 (FIG. 9B). Accordingly, there have been drawbacks that the writing operation can not be continued and further knocking of the mechanical pencil is necessary.

SUMMARY OF THE INVENTION

It is an object of the present invention to provide a knocking-type mechanical pencil wherein a remaining or unconsumed lead can be used until its length is shortened, and even if the front end of the lead is made to abut on a paper surface during a writing operation, the lead of which the tip protrudes from a front end of a slider does not retract into the slider.

It is another object of the present invention to provide a knocking-type mechanical pencil having a front end pipe disposed at a front end of a mouthpiece so that the remaining lead can be used until its length is shortened and the remaining lead does not retract into the front end pipe during a writing operation.

The foregoing and other objects of the present invention are carried out by a mechanical pencil comprising a cylindrical main body, a mouthpiece, a slider slidably fitted in the mouth piece, and a lead-feeding mechanism disposed in the cylindrical main body for gripping a lead at a lead-gripping position and for feeding the lead to an advanced position. A lead-holding member is disposed in the slider and frictionally holds the lead fed to the advanced position. A slider-resisting member is disposed in contact with the slider so that a frictional resistance larger than a frictional resistance of the lead-holding member is applied to the slider. A releasing portion for releasing the slider-resisting member brings the slider-resisting member in slight contact with or non-contact with the slider so that the frictional resistance of the slider-resisting member is smaller than the frictional resistance of the lead-holding member in a zone which corresponds to a return amount when the lead fed to the advanced position by the lead-feeding mechanism returns to the lead-gripping position.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown, and the scope of the invention will be pointed out in the appended claims. In the drawings:

FIG. 6(A) is an explanatory view showing the slider placed at a protruded end, and FIG. 6(B) is an explanatory view showing the slider fitted in a slider-resisting member of the mechanical pencil;

FIG. 9(A) shows the state where a slider is placed at a protruded end and FIG. 9(B) shows the state during a writing operation.

DETAILED DESCRIPTION OF THE PREFERRED EMBODIMENTS

While this invention is susceptible of embodiments in many different forms, this specification and the accompanying drawings disclose only certain examples of the use of the invention. The invention is not intended to be limited to the embodiments so described, and the scope of the invention will be pointed out in the appended claims.

Figure 1:
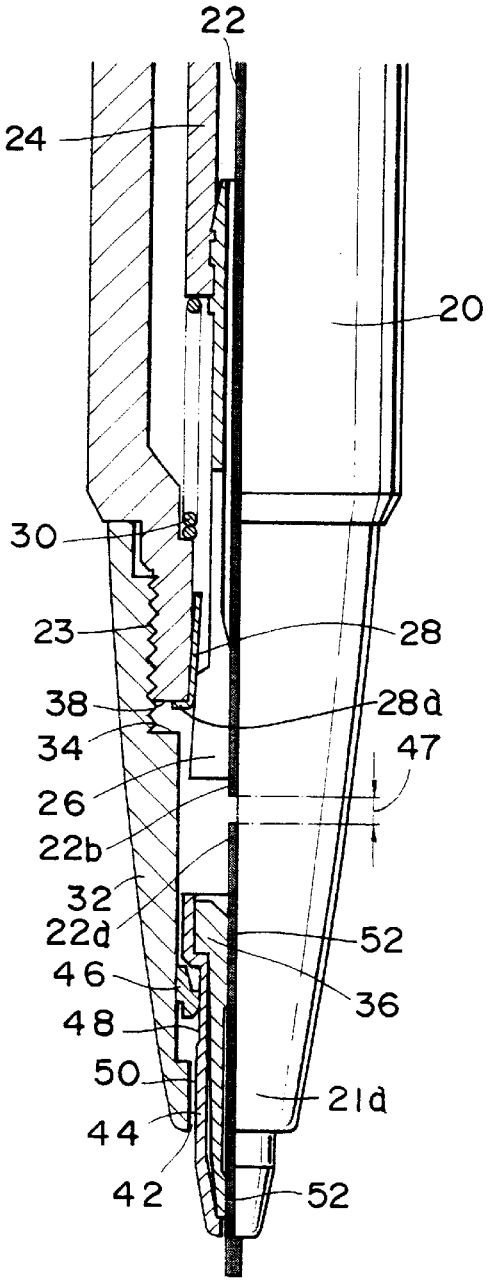
FIG. 1 is a front view, partly in cross section, showing an embodiment of the mechanical pencil according to the present invention.

FIG. 1 shows an embodiment of a mechanical pencil according to the present invention. The mechanical pencil has a generally cylindrical-shaped main body 20 and a mouthpiece 32 connected to the main body by mating threads 23. A lead-feeding mechanism is disposed in the main body 20 for feeding a lead 22 toward a front end portion 21*a* of the mouthpiece. The lead-feeding mechanism has a lead tank 24, a collet chuck 26, a clutch 28 and a spring 30. The main body 20 has a shoulder portion 38 on which a flange 28a of the clutch 28 abuts. The mouthpiece 32 has a stepped portion 34 in confronting relation to the shoulder portion 38 of the main body 20. A slider 44 extends into a bore 42 of the mouthpiece 32 for sliding movement therein. A lead-holding member 36 is disposed in the slider 44 for frictionally holding the lead 22. A slider-resisting member 46 is disposed between an outer periphery of the slider 44 and an inner surface of the mouth piece 32 so as to apply to the slider 44 a frictional resistance larger than a frictional resistance of the lead-holding member 36.

When the lead tank 24 is knocked, the lead 22 is fed from a gripping position to an advanced position, and the slider 44 is pushed by the collet chuck 26, under the resistance of the slider-resisting member 46, and protrudes from the mouthpiece 32. When the knocking is stopped and the collet chuck 26 returns to the gripping position, the lead 22 fed to the advanced position by the lead-feeding mechanism is gripped by the returning collet chuck and the lead is thereby moved slightly backwards.

Figure 2:
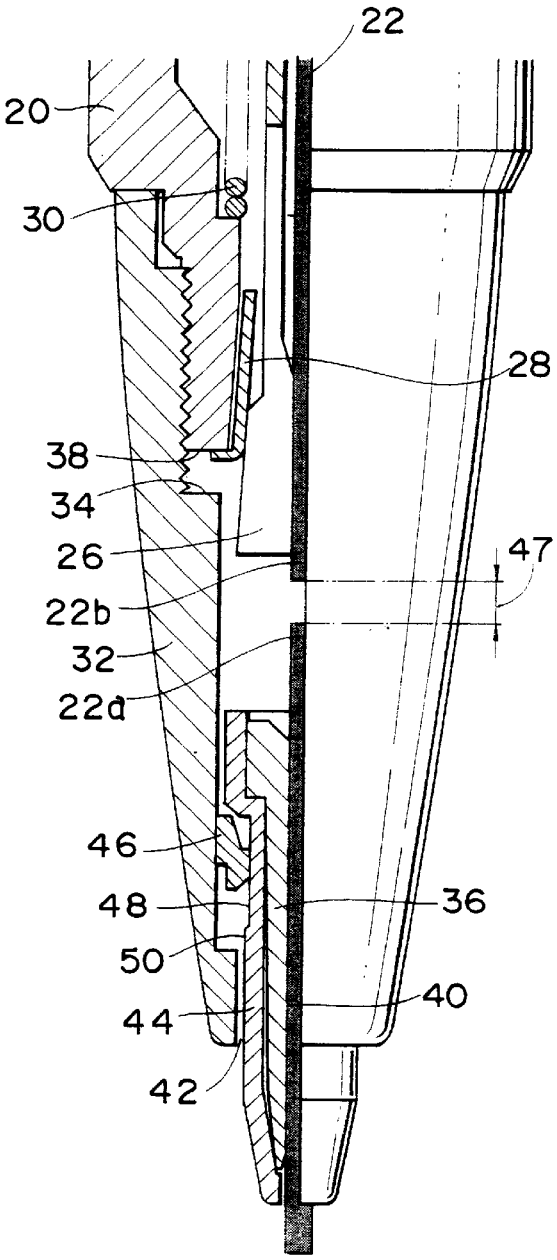
FIG. 2 is a front view, partly in cross section, showing an enlarged view of a mouthpiece portion of the mechanical pencil.

According to the present invention, a releasing portion for releasing the slider-resisting member 46 is disposed so that the frictional resistance of the slider-resisting member 46 would be smaller than the frictional resistance of the lead-holding member 36 or no frictional resistance would be applied in the zone which corresponds to the return amount of the lead 22. In the embodiment shown in FIGS. 1–3, a releasing portion 48 comprises a small diameter portion of the outer periphery of the slider 44 which is smaller than the remaining diameter portions thereof. The releasing portion 48 extends between a position where the slider-resisting member 46 confronts the slider 44 when the slider is set at the protruded end and a position where the slider-resisting member 46 confronts the slider 44 when the slider moves backwardly to an extent corresponding to the return amount of the lead 22. When the slider-resisting member 46 confronts the releasing portion 48, the pressing force of the slider-resisting member 46 is lessened, or in some cases, the slider-resisting member 46 can be brought into a non-contact state with the outer surface of the slider 44, whereby the frictional resistance of the slider-resisting member 46 can be made smaller than the frictional resistance of the lead-holding member 36, or can be lost.

The slider 44 has a pressing portion 50 disposed at a front part of the peripheral surface thereof beyond the releasing portion 48. The pressing portion 50 has a diameter larger than the diameter of the releasing portion 48. When the slider-resisting member 46 confronts the pressing portion 50, a frictional resistance larger than the frictional resistance of the lead-holding member 36 is generated, and resistance is applied to the movement of the slider 44.

In the foregoing embodiment, the releasing portion 48 constitutes a small diameter portion or zone of the slider 44 where the frictional resistance of the slider-resisting member 46 can be lessened or lost. The length of the releasing portion 48 corresponds to the return amount of the lead 22 when the lead 22 fed to the advanced position by the lead-feeding mechanism returns to the gripping position. Alternatively, the releasing portion 48 may comprise, for example, a concave portion (not shown) which is formed in the inner surface of the mouth piece 32, which has a large inner diameter, and which has a length corresponding to the return amount of the lead 22. In the alternative embodiment, the slider-resisting member 46 is provided on the slider 44 in confronting relation to the concave portion.

Figure 3:
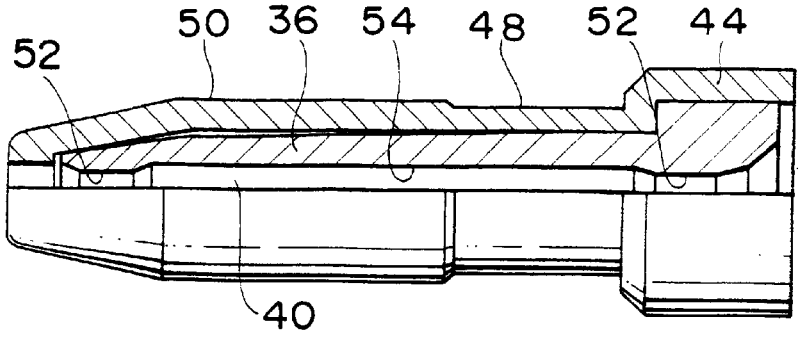
FIG. 3 is a front view, partly in cross section, showing a slider of the mechanical pencil of FIG. 1.

As shown in FIG. 3, the lead-holding member 36 disposed in the slider 44 is formed into a long sleeve-like shape having a lead hole 40 formed therein. The lead-holding member 36 has two lead-holding portions 52 disposed at opposite end portions of the lead hole 40 for contacting and frictionally holding the lead 22, and an intermediate portion 54 disposed between the lead-holding portions 52 and which does not contact the lead 22. In an alternative embodiment (not shown), a plurality of lead-holding portions 52 may also be disposed in the intermediate portion 54, or the entire length of the lead hole 40 may be configured as a lead-holding portion for contacting and frictionally holding the lead 22. In a further alternative embodiment (not shown), the slider 44 may be formed integral with the lead-holding member 36 (e.g., formed in two pieces integrally connected together or formed in one piece) so that the slider 44 itself can be used as a lead-holding member.

Figure 4:
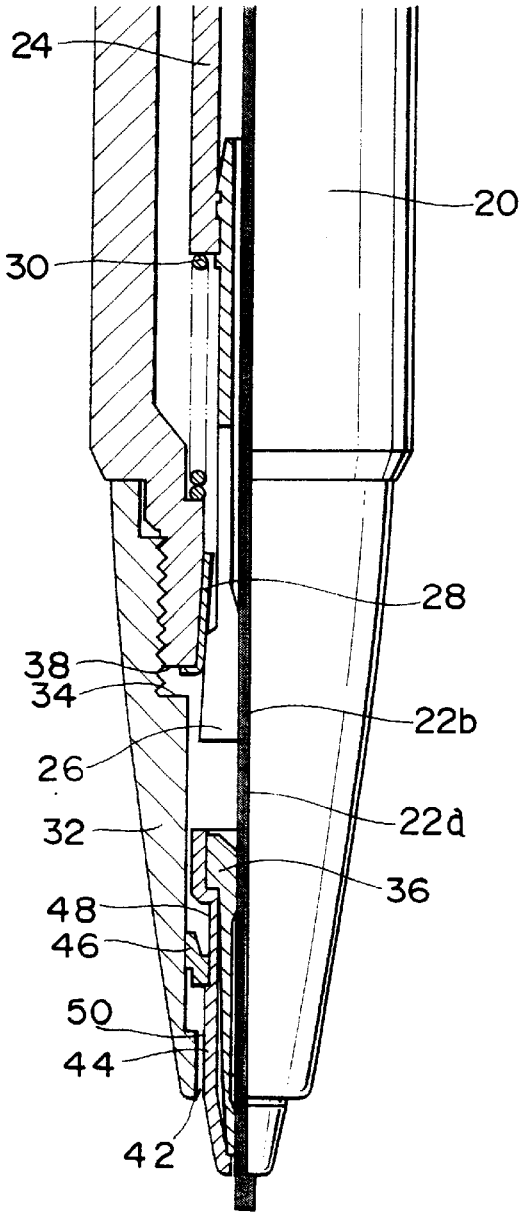
FIG. 4 is a front view, partly in cross section, showing the state where a front end of a remaining lead of the mechanical pencil of FIG. 1 abuts on a paper surface.

When a preceding remaining lead portion 22*a* is no longer gripped by the collet chuck 26 and a following lead portion 22*b* is gripped by the collet chuck 26 as shown in FIG. 1, the remaining lead portion 22*a* is held by the lead-holding member 36 in such a state that a front end of the remaining lead portion 22*a* protrudes from the slider 44, and a space 47 is formed between the rear end of the remaining lead portion 22*a* and the following lead portion 22*b* in the zone corresponding to the return amount of the lead 22. When a writing operation is conducted in this state, the frictional resistance of the slider-resisting member 46 is smaller than the frictional resistance of the lead-holding member 36 or is lost in the zone corresponding to the return amount of the lead. Accordingly, when the front end of the lead 22 abuts on the paper surface, the remaining lead portion 22*a* returns together with the slider 44 while the lead 22 is held by the lead-holding member 36 without slipping within the lead-holding member 36, and the front end of the remaining lead portion 22*a* protrudes from the slider 44. The rear end of the remaining lead portion 22*a* then abuts on the front end of the following lead portion 22*b* and stops (FIG. 4), and the writing operation can be continued as usual.

Figure 5:
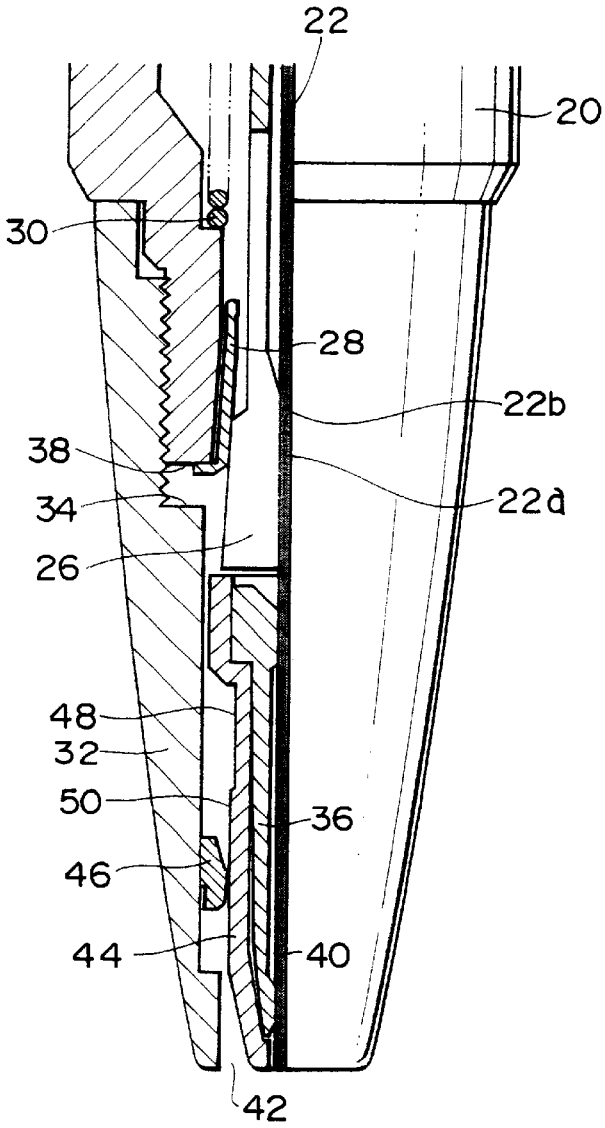
FIG. 5 is a front view, partly in cross section, showing the state where a slider is housed in the mouthpiece of the mechanical pencil.

When it is required to house the slider 44 by pressing the front end of the slider 44 against the paper surface or the like in such a state that the lead tank 3 is knocked as usual, the entire slider 44 can be housed in the mouthpiece 32 as shown in FIG. 5. At this time, the slider-resisting member 46 is placed in confronting relation to the pressing portion 50 of the slider 44 so as to restrain the slider 44 with a frictional resistance larger than the frictional resistance of the lead-holding member 36, and the slider 44 will not protrude unnecessarily from the front end of the mouthpiece 32.

Figure 6:
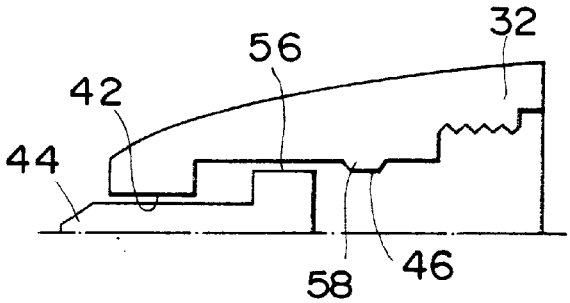
FIGS. 6(A) and 6(B) show another embodiment of the mechanical pencil according to the present invention, where.
Figure 6:
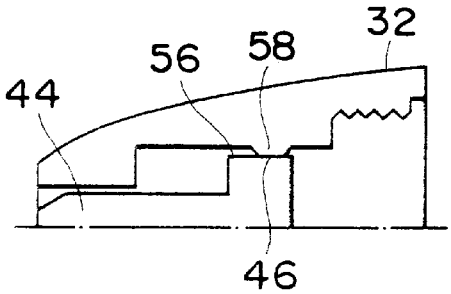

In the foregoing embodiments, the slider-resisting member 46 is disposed between the outer peripheral portion of the slider 44 and the inner surface of the mouthpiece 32. In an alternative embodiment, a slider-resisting member may be provided by forming a projection on the inner surface of the mouthpiece 32. For example, as shown in FIGS. 6(A) and 6(B), a large diameter head portion 56 is formed at the rear end of the slider 44, and a projection 58 which constitutes the slider-resisting member and which can contact the head portion 56 is formed by undercutting the inner surface of the mouthpiece 32. The length of a space portion in an axial direction between the head portion 56 and the projection 58 corresponds to the return amount of the lead when the lead is fed by the lead-feeding mechanism as described above, and this space portion corresponds to the releasing portion as described above for the foregoing embodiments. By this construction, when the slider 44 returns from the protruded end, it freely returns until the head portion 56 abuts on the projection 58. However, when the head portion 56 fits in or engages with the projection 58, the projection 58 becomes a resisting portion which resists transfer of the slider 44, and the remaining lead portion 22*a* can be moved backwardly until its rear end abuts on the front end of the following lead portion 22*b* in such a state that the remaining lead portion 22*a* protrudes from the front end of the slider 44 in substantially the same manner as described above for the foregoing embodiments.

In the case of mechanical pencils wherein a front end pipe is formed at a mouthpiece and a lead-holding member is disposed in the front end pipe and extends near to the front end of the front end pipe, it is advisable that the front end pipe can move backwardly in the zone corresponding to the return amount of the lead. Such a problem can be solved by a structure such that a projection and a concave portion in which the projection fits are disposed between the inner face of the mouthpiece and the outer face of the front end pipe, and the front end pipe can move in an axial direction within the range formed by the concave portion and the projection. Embodiments of such mechanical pencil construction according to the present invention are shown in FIGS. 7(A)–7(C).

Figure 7A:
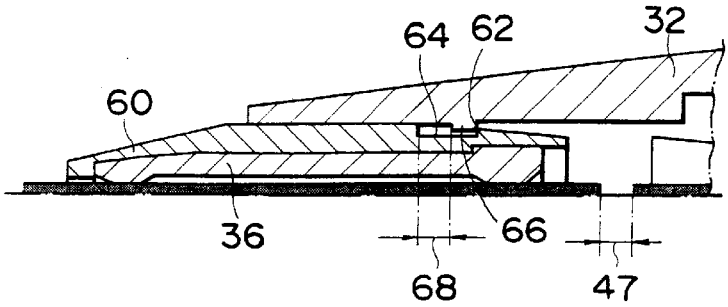
FIGS. 7(A) to 7(C) are partial cross-sectional views of other embodiments of the mechanical pencil according to the present invention.

In the embodiment shown in FIG. 7(A), a front end pipe 60 supporting the lead-holding member 36 which extends near to the front end of the front end pipe 60 is inserted into the mouthpiece 32. A concave portion 64 is formed in an outer peripheral surface portion of the front end pipe 60 and communicates with an inward flange 62 of the front end pipe 60. A projection 66 extends from an inner peripheral surface of the mouthpiece 32 and is received within the concave portion 64. A distance 68 that the front end pipe 60 moves backwardly is defined by the distance which the front end pipe 60 moves until a terminal end of the concave portion 64 abuts on the projection 66. The width of the concave portion 64 and the width of the projection 66 are selected to be substantially the same as the distance of the space 47 that the lead 22 returns. In this connection, the inward flange 62 functions as a stopper of the front end pipe 60.

Figure 7B:
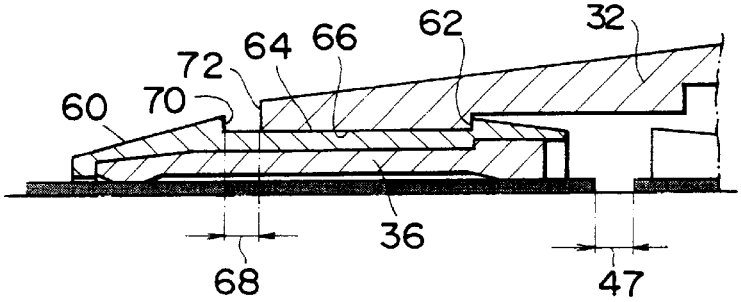

In the embodiment shown in FIG. 7(B), an outward flange 70 is formed on an outer peripheral surface of the front end pipe 60 projecting from the mouthpiece 32. A wide-spread concave portion 64 is formed between the outward flange 70 and the inward flange 62. In this embodiment, the portion of the mouthpiece 32 extending from an inward stepped portion to a front end face 72 of the mouthpiece 32 constitutes the projection 66. The distance 68 that the front end pipe 60 returns is defined by the distance which the front end pipe 60 moves until the front end face 72 of the mouthpiece 32 abuts on the outward flange 70.

Figure 7C:
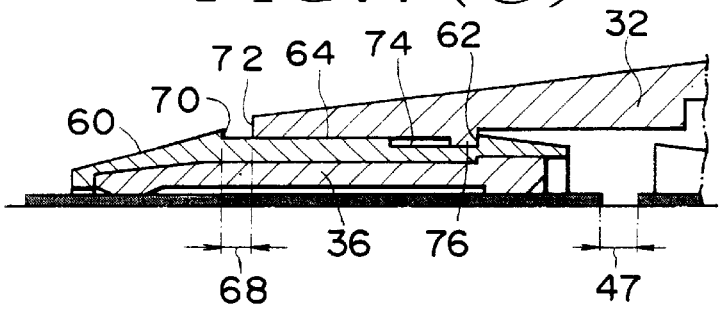

In the embodiment shown in FIG. 7(C), an inward concave portion 74 which communicates with the inward flange 62 is formed in an outer peripheral surface portion of the front end pipe 60. An inward projection 76 which is to be fitted in the inward concave portion 74 extends from an outer peripheral surface portion of the mouthpiece 32. A concave portion 64 is formed between the inward flange 62 and the outward flange 70. The front end face 72 of the mouthpiece 32 is another end of the projection against which the outward flange 70 abuts.

Figure 8A:
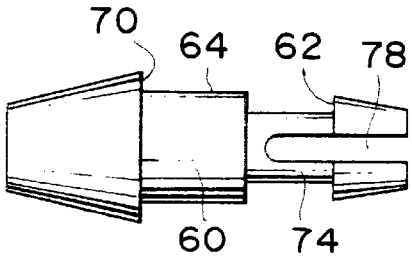
FIGS. 8(A) and 8(B) are front views showing front end pipes of the mechanical pencil according to embodiments of the present invention.
Figure 8B:
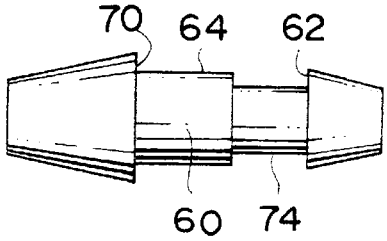
Figure 9:
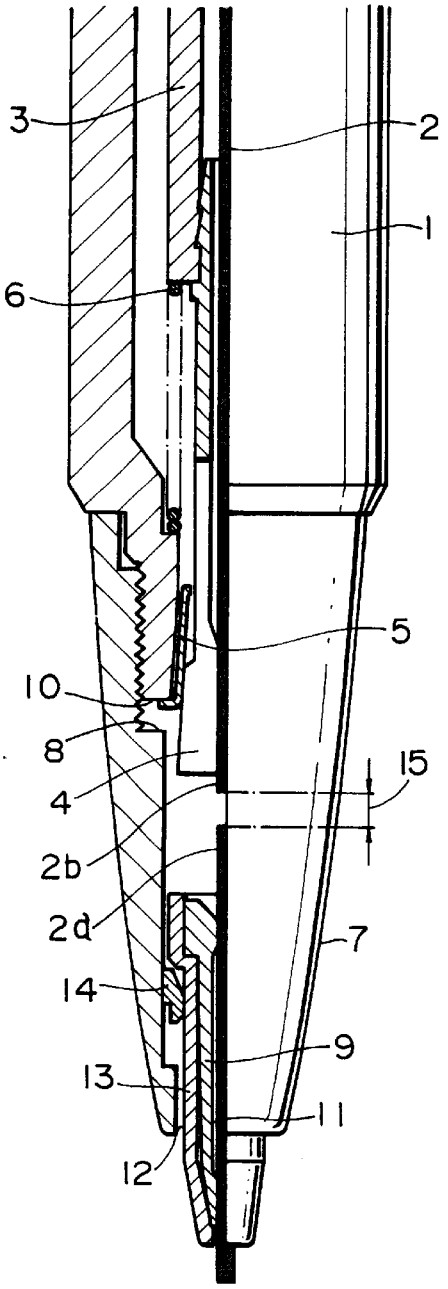
FIGS. 9(A) and 9(B) are front views, partly in cross section, of a conventional mechanical pencil, where
Figure 9:
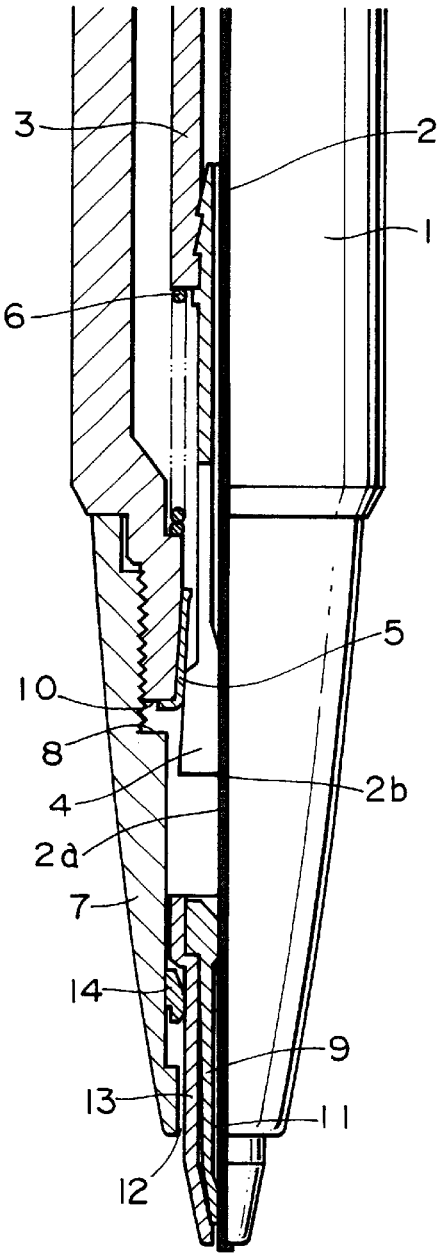

The front end pipe 60 in the embodiments shown in FIGS. 7(A) to 7(C) are inserted from the front end of the mouthpiece 32. In an alternative embodiment, the front end pipes 60 may have a structure as shown in FIG. 8(A) in which a slit 78 is formed at an insertion end side so that the insertion end side would be bent in the axial direction when it is inserted. In another embodiment, the front end pipes 60 may have a structure as shown in FIG. 8(B) in which the outer diameter of the inward flange 62 at the insertion end side has a diametrical size which allows it to be press-fitted with the projection of the mouthpiece 32. In these embodiments, the concave portion and the projection may be combined so that they may be in non-contact with one another or in contact with one another with a resistance weaker than the lead-holding force of the lead-holding member.

From the foregoing description, it can be seen that the present invention provides a mechanical pencil having a cylindrical main body, a lead-feeding mechanism disposed in the cylindrical main body wherein a lead is gripped at a lead-gripping position and fed to an advanced position, a mouthpiece, and a slider slidably fitted in the mouthpiece. A lead-holding member is disposed in the slider for frictionally holding the lead fed to the advanced position. A slider-resisting member is disposed in contact with the slider so that a frictional resistance larger than a frictional resistance of the lead-holding member is applied to the slider. A releasing portion for releasing the slider-resisting member brings the slider-resisting member into slight contact with or non-contact with the slider so that the frictional resistance of the slider-resisting member would be smaller than the frictional resistance of the lead-holding member in a zone which corresponds to a return amount of the lead when the lead fed to the advanced position by the lead-feeding mechanism returns to the lead-gripping position.

As described above, the present invention also provides a mechanical pencil having a mouthpiece, a front end pipe disposed in the mouth piece, and a lead-holding member disposed in the front end pipe and extending near to the front end of the front end pipe. In this embodiment, the range of movement of the front end pipe is controlled by a concave portion and a projection so that the front end pipe can move backwardly.

By the foregoing construction of the mechanical pencil according to the present invention, even if the remaining lead portion is shortened and it abuts on the paper surface in such a state that the front end of the remaining lead portion protrudes from the mouth piece, the slider and the front end pipe move backwardly until the rear end of the remaining lead portion abuts on the following lead portion while the front end of the remaining lead portion protrudes, and the front end of the remaining lead portion does not retract. Accordingly, the writing operation can be made easily, and the slider-resisting member applies a frictional resistance against the slider during the following movement of the slider, by which the slider will not unnecessarily protrude from the front end of the mouth piece or the slider will not retract, thereby providing a mechanical pencil which can be used to perform a writing operation with high efficiency.

From the foregoing description, it can be seen that the present invention comprises an improved mechanical pencil. It will be appreciated by those skilled in the art that obvious changes can be made to the embodiment described in the foregoing description without departing from the broad inventive concept thereof. It is understood, therefore, that this invention is not limited to the particular embodiment disclosed, but is intended to cover all obvious modifications thereof which are within the scope and the spirit of the invention as defined by the appended claims.

What is claimed is:

1. A mechanical pencil comprising: a main body; a lead-feeding mechanism disposed in the main body for gripping a lead at a lead-gripping position and for feeding the lead to an advanced position; a mouthpiece connected to the main body; a slider slidably fitted in the mouthpiece; a lead-holding member disposed in the slider for frictionally holding the lead fed to the advanced position; a slider-resisting member disposed in contact with the slider for applying a frictional resistance to the slider larger than a frictional resistance of the lead-holding member; and control means for controlling the frictional resistance applied to the slider by the slider-resisting member to bring the slider-resisting member in slight contact with or non-contact with the slider so that the frictional resistance of the slider-resisting member is smaller than the frictional resistance of the lead-holding member in a region corresponding to a return amount of the lead when the lead fed to the advanced position by the lead-feeding mechanism returns to the lead-gripping position.

2. A mechanical pencil according to claim 1; wherein the slider-resisting member is disposed in the mouthpiece; and wherein the control means comprises a releasing portion formed around an outer peripheral surface of the slider in a region from a protruded end of the slider to a point corresponding to the return amount of the lead.

3. A mechanical pencil according to claim 2; wherein an outer diameter of the releasing portion is smaller than other portions of the slider.

4. A mechanical pencil according to claim 1; wherein the control means comprises a releasing portion formed around an outer peripheral surface of the slider in a region from a protruded end of the slider to a point corresponding to the return amount of the lead.

5. A mechanical pencil according to claim 1; wherein the control means comprises a releasing portion formed in a space disposed between a rear end of the slider and the slider-resisting member and disposed in a region from a protruded end of the slider to a point corresponding to the return amount of the lead.

6. A mechanical pencil according to claim 1; wherein the main body is generally cylindrical-shaped.

7. A mechanical pencil comprising: a main body; a lead-feeding mechanism disposed in the main body for gripping a lead at a lead-gripping position and for feeding the lead to an advanced position; a mouthpiece connected to the main body; a front end pipe disposed on the mouthpiece; a lead-holding member disposed in the front end pipe for frictionally holding the lead fed to the advanced position; and control means for controlling a range of movement of the front end pipe so that the front end pipe can move backward in a region corresponding to a return amount of the lead when the lead fed to the advanced position by the lead-feeding mechanism returns to the gripping position.

8. A mechanical pencil according to claim 7; wherein the control means comprises a projection formed on a surface of the mouthpiece and a concave portion formed on a surface of the front end pipe for receiving the projection.

9. A mechanical pencil according to claim 7; wherein the control means comprises a projection formed on a surface of the front end pipe and a concave portion formed on a surface of the mouthpiece for receiving the projection.

10. A mechanical pencil according to claim 7; wherein the main body is generally cylindrical-shaped.

* * * * *